US010434552B2

(12) United States Patent
Runkel et al.

(10) Patent No.: US 10,434,552 B2
(45) Date of Patent: Oct. 8, 2019

(54) METHOD AND DEVICE FOR PRODUCING A METALLIC STRIP IN A CONTINUOUS CASTING AND ROLLING PROCESS

(71) Applicant: SMS GROUP GMBH, Düsseldorf (DE)

(72) Inventors: Thomas Runkel, Siegen (DE); Christian Mengel, Siegen (DE)

(73) Assignee: SMS GROUP GMBH, Düsseldorf (DE)

( * ) Notice: Subject to any disclaimer, the term of this patent is extended or adjusted under 35 U.S.C. 154(b) by 343 days.

(21) Appl. No.: 14/907,039

(22) PCT Filed: Jul. 24, 2014

(86) PCT No.: PCT/EP2014/065979
§ 371 (c)(1),
(2) Date: Jan. 22, 2016

(87) PCT Pub. No.: WO2015/011248
PCT Pub. Date: Jan. 29, 2015

(65) Prior Publication Data

US 2016/0175903 A1 Jun. 23, 2016

(30) Foreign Application Priority Data

Jul. 26, 2013 (DE) ..... 10 2013 214 667
Oct. 14, 2013 (DE) ..... 10 2013 220 657

(51) Int. Cl.
*B21B 1/22* (2006.01)
*B21B 15/00* (2006.01)
(Continued)

(52) U.S. Cl.
CPC ..... *B21B 1/463* (2013.01); *B21B 1/24* (2013.01); *B21B 15/0007* (2013.01); *B22D 11/16* (2013.01)

(58) Field of Classification Search
CPC ..... B21B 13/22; B21B 1/224; B21B 1/46; B21B 1/463; B21B 1/24; B21B 15/0007; B22D 11/00; B22D 11/06; B22D 11/16
See application file for complete search history.

(56) References Cited

U.S. PATENT DOCUMENTS 4,976,024 A * 12/1990 Kimura ..... B21B 1/466 164/417
5,528,816 A 6/1996 Donini et al.
(Continued)

FOREIGN PATENT DOCUMENTS

CN 1114244 A 1/1996
CN 102056690 A 5/2011
(Continued)

OTHER PUBLICATIONS

English Translation of Korean Office Action, dated Oct. 5, 2016.

*Primary Examiner* — Ryan J. Walters
*Assistant Examiner* — Lawrence Averick
(74) *Attorney, Agent, or Firm* — Lucas & Mercanti, LLP; Klaus P. Stoffel

(57) ABSTRACT

A method for producing a metallic strip by continuous casting-rolling, wherein a slab is cast in a casting machine and then sent to a finishing mill located downstream, relative to the transport direction of the strip. In the event that the transport of the slab or strip comes to a complete or substantially complete standstill, the following steps are carried out: (a) cutting through the strip at a first point; (b) cutting through the strip at a second point that is 0.1-5.0 m upstream from the first point; (c) removing the cut-out piece of strip to create a gap in the strip; (d) conveying new strip material into the area of the gap from the area located upstream of the first point; and (e) cutting off pieces of the
(Continued)

new strip material conveyed from upstream according to step (d) and removing the pieces from the transport line.

10 Claims, 11 Drawing Sheets

(51) Int. Cl.

| | |
|---|---|
| ***B21B 13/22*** | (2006.01) |
| ***B21D 11/00*** | (2006.01) |
| ***B21B 1/46*** | (2006.01) |
| ***B22D 11/16*** | (2006.01) |
| ***B21B 1/24*** | (2006.01) |

(56) References Cited

U.S. PATENT DOCUMENTS

| | | | | |
|---|---|---|---|---|
| 5,542,165 | A | 8/1996 | Coassin et al. | |
| 5,548,882 | A * | 8/1996 | Windhaus | B21B 1/466 164/417 |
| 6,035,682 | A * | 3/2000 | Dorigo | B21B 1/0815 72/200 |
| 8,276,647 | B2 * | 10/2012 | Hohenbichler | B21B 1/463 164/263 |
| 8,286,691 | B2 | 10/2012 | Benedetti | |
| 8,327,918 | B2 * | 12/2012 | Seidel | B21B 1/463 164/155.3 |
| 8,453,711 | B2 | 6/2013 | Hohenbichler et al. | |
| 2002/0095764 | A1 * | 7/2002 | Bald | B21B 1/466 29/527.7 |
| 2004/0232605 | A1 | 11/2004 | Rosenthal | |
| 2010/0147484 | A1 | 6/2010 | Rosenthal et al. | |
| 2010/0163205 | A1 * | 7/2010 | Seidel | B21B 1/463 164/452 |
| 2010/0175452 | A1 | 7/2010 | Ohlert | |
| 2011/0056649 | A1 * | 3/2011 | Hohenbichler | B21B 1/463 164/460 |
| 2011/0308757 | A1 * | 12/2011 | Benedetti | B21B 1/463 164/460 |
| 2016/0325324 | A1 * | 11/2016 | Merz | B21C 47/267 |

FOREIGN PATENT DOCUMENTS

| | | | |
|---|---|---|---|
| DE | 102007058709 | A1 | 2/2009 |
| EP | 2259886 | B1 | 5/2012 |
| KR | 1020090032195 | A1 | 4/2009 |
| RU | 2114707 | C1 | 7/1998 |
| RU | 2217247 | C2 | 11/2003 |
| RU | 2434696 | C1 | 9/2011 |
| RU | 2010135757 | A | 2/2012 |
| WO | 2009018957 | A1 | 2/2009 |

* cited by examiner

METHOD AND DEVICE FOR PRODUCING A METALLIC STRIP IN A CONTINUOUS CASTING AND ROLLING PROCESS

The present application is a 371 of International application PCT/EP2014/065979, filed Jul. 24, 2014, which claims priority of DE 10 2013 214 667.1, filed Jul. 26, 2013, US 61/870,507, filed Aug. 27, 2013, DE 10 2013 220 657.7, filed Oct. 14, 2013, and US 61/908,949, filed Nov. 26, 2013 the priority of these applications is hereby claimed and these applications are incorporated herein by reference.

BACKGROUND OF THE INVENTION

The invention pertains to a method for the production of metallic strip by the continuous casting-rolling process, in which a slab is first cast in a casting machine and then sent to a finishing mill located downstream in the transport direction, where it is rolled. The invention further pertains to a device for producing a metallic strip.

The present invention is used in casting-rolling installations which produce finished strip from molten metal in endless operation. For installations of this type, an emergency strategy is proposed for dealing with breakdowns.

Known casting-rolling lines convert molten steel to hot strip in a compact installation. The first step is to cast a slab of endless length.

These slabs are cut by shears into sections, the dimensions which correspond to the desired size of the hot coil. The slabs are conditioned to the proper temperature in heating furnaces, often designed as roller hearth furnaces. Then the slabs are sent individually to a rolling mill and rolled. After the strips have been cooled in a cooling section and wound into coils, the coils are taken from the rolling line for further processing.

In the case of the "semi-endless" method, the slab is cut in such a way that two or more coils can be produced from it. Downline from the rolling mill, a flying shear is also installed, which cuts the long hot strip to obtain a coil of the desired size. With this method, the number of critical threading-in and threading-out operations required during rolling is reduced, which makes it possible to produce thinner hot strips more reliably.

Common to both methods is that, because the slabs are cut into sections, the casting process and the rolling process can be carried out separately. The working speeds of the casting machine and the rolling mill which can and must be used can thus be determined independently of each other.

As a result of progress in the design of casting machines and in process control through the use of, for example, heating devices, it is possible today to eliminate the step of cutting the slab into sections prior to rolling. A so-called "fully continuous" process was developed. According to this process, the slab is allowed to solidify completely and is then sent to the rolling mill undivided, and all the while more molten metal is being cast onto the same strand in the casting machine. The material is not cut into coiling lengths until it reaches the flying shear downline from the rolling mill.

In this fully continuous process, therefore, operating states regularly occur in which the material forms a single physical entity extending all the way from the casting machine to the coiler. The entire process thus takes place continuously or in endless fashion.

Breakdowns occur sporadically in systems of this magnitude, which can be over several hundred meters in length. For example, when there is a malfunction in the hot strip line or a problem with the shears, etc., the production process must be interrupted. The system is then stopped and all movements of the strip or of the slab come to a standstill. It is possible for an undivided strand, the various parts of which are in different stages of processing, to extend over the entire length of the installation. Because this strand can be 100 meters or more in length as it extends through the various units (casting machine, shears, furnaces, rolling mill, coiler), a part of the strand in one unit cannot be moved independently of a part in another unit.

In principle, a breakdown can occur in any of the units; that is, it can occur in the area of the coiler, of the flying shear, of the finishing mill, of the roller hearth furnace, etc. A disruption in the finishing mill as the result of, for example, a tear in the strip between the last two stands thus leads within a very short time to a backup of material between these stands, which can be corrected only by subsequent manual operations. Several minutes of work are required for this, and then an inspection must be performed. Some repairs to parts of the installation may also be necessary.

When a breakdown occurs, the control operator or the automation system stops the rolling. The stands can usually be opened up very quickly; all of the drives are turned off; and the strand comes to a stop. Because the slab is not divided between this point and the mold, there are cases in which it is also necessary to stop the casting machine.

The casting unit is especially critical in such cases. If the shutdown lasts too long, the steel solidifies in the mold. Removing this steel is a very difficult job, which is likely to damage the mold. Opening the mold and the strand guides will usually cause the strand to rupture, allowing molten steel to pour over the unit, thus causing considerable damage. In particular, the strand guide rollers are susceptible to thermal overload during prolonged idle periods.

Removing the solidified cast strand from the casting machine is very time-consuming, and often it can be done only by cutting the strand by hand (e.g., flame cutting). Crane work is necessary here, and the mold and possibly parts of the strand casting machine must be replaced. This leads to very long down times and to lost production, and it is also associated with various types of manual operations.

EP 2 259 886 B1 proposes in this situation that the strip be cut, that the tail end of the section of strip downstream of the cut be bent upward, and that the strip upstream of the cut be cut into scrap. This method is based logically on the assumption that the upstream strip material is still moving. The method cannot be used if the strip has already come to a complete stop, that is, if the continuous process has already come to a standstill.

There is no known concept for dealing with a breakdown in which the production material has already come to a complete stop. That is, in the situation in which the production material has come to a complete stop, there is so far no way of quickly disposing of the production material by, for example, cutting it into scrap at the flying or movable shear. The previous solutions assume instead that the slab is still movable and that it is therefore possible to move the slab through a shear to chop it up. There are various types of breakdowns in which this is not possible, however, and it is especially problematic when the slab or the strip has already come to a complete stop after a production breakdown.

SUMMARY OF THE INVENTION

In light of the problems described above, the invention is based on the goal of returning the production line to a state which allows production to be resumed after the occurrence of a breakdown and to do so safely, quickly, and economically, as well as preferably partially of fully automatically. Special attention is to be paid here to the removal of the slab or the solidifying steel as quickly as possible from the mold and also from the casting machine in order to minimize the possible damage and down time. Finally, the goal is to deal with the material present in the installation in such a way that as much of it as possible remains suitable for further processing.

The inventive achievement of this goal is characterized in that, in the event of a production breakdown and a complete or near complete stoppage of the transport of the slab or strip, the following steps are carried out:

(a) cutting through the strip at a first point;

(b) cutting through the strip at a second point, wherein the second point is in the range of 0.1-5.0 m, and preferably of 0.2-1.0 m, upstream, relative to the transport direction, from the first point;

(c) removing, particularly conveying away, the cut-out piece of strip from the transport line to create a gap in the strip;

(d) conveying new strip material into the area of the gap from the area located upstream, relative to the transport direction, of the first point; and (e) cutting off pieces of the new strip material conveyed from upstream according to step (d) and removing, particularly conveying away, the pieces from the transport line (chopping operation).

The separating also encompasses, for example, letting the cut strip pieces fall into an intake provided therefore.

The chopping operation also makes possible a removal of the cast strand out of the casting machine.

The second point lies preferably upstream of the first point.

The first and second points are preferably located between the casting machine and the finishing mill. It is both possible and advantageous, however, for the first and second points to be located between a roughing mill immediately downstream from the casting machine and a furnace downstream from the roughing mill. The first and second points can be located between a furnace downstream from the casting machine and the finishing mill.

The concept can be used in all types of system concepts with desired combinations of casting machines, roughing mill, furnace, intermediate rolling mill and finishing mills.

To make the cuts, a single separating device can be used. An oscillating shear or a gate shear is preferred.

The above-mentioned steps (d) and (e) are preferably repeated until the casting machine has been freed of strip material or a section of defined length in the casting machine is free of strip material.

According to a special procedure, the above-mentioned steps (a)-(c) can be carried out by means of a first separating device, and steps (d) and (e) can be carried out by means of a second separating device, wherein the two separating devices are located at different points relative to the transport direction.

According to a special elaboration of the method, furthermore, the strip material is conveyed out of the finishing mill opposite the transport direction back into the area of at least one separating device, where pieces of the conveyed strip material are cut off by the at least one separating device, and the cut-off pieces are removed from the transport line (chopping operation).

Means for applying a straightening force to the strip material can be arranged next to the at least one separating device to exert a force perpendicular to the surface of the strip. Thus the tail end of the strip can be straightened in a given case.

The gap can be produced by two or possibly by more than two cuts of the separating device.

When a furnace is present in the installation, it is also possible to provide that, first, a gap is cut in the strand as described, and then the strip material present in the furnace is shortened to a desired length by means of the at least one separating device but otherwise remains in the furnace. This makes it possible for the shortened strip material to be held in the furnace at a high temperature and then easily rolled out after the problem has been corrected. In this case, the separating device is preferably located upstream or downstream from the furnace.

The device for producing a metallic strip in the continuous casting-rolling method comprises a casting machine, at least one furnace, a first and a second separating device for the strip or for the slab from which the strip is produced, a finishing mill, a cooling section, and at least two coilers; and, according to the invention, it provides that a central fault reporting system is present, which is connected to the above-mentioned components of the installation and which can monitor their process state.

The fault reporting system is in particular configured in such a way that abnormalities pertaining to the mass flow in the components of the installation can be detected. The fault reporting system can be configured in particular in such a way that it can trigger an alarm when abnormalities lying outside a predetermined tolerance range are detected in at least one of the installation's components. It can be configured to activate the first and/or the second separating device as soon as abnormalities lying outside a predetermined tolerance range pertaining to the mass flow in the components of the installation are detected.

The first and/or the second separating device is preferably configured so that the strip or the slab from which the strip is produced can be cut at two points adjacent to each other in the transport direction; these adjacent points are preferably at least 200 mm apart in the transport direction.

Downstream, relative to the transport direction, of the first and/or the second separating device, at least one vertically movable roller can be arranged.

The furnace is preferably configured as a tunnel furnace or as some other type of heating device. In addition, a flying shear can be present. The central fault reporting (problem reporting) system covers all parts of the installation. Whenever there is a critical mass flow problem at one of the installation's components, an alarm is triggered, which causes all of the individual components to stop the mass flow in a controlled manner. There is preferably a direct connection to the first separating device, to which a signal is transmitted for the immediate separation of the material.

The first separating device, which is arranged downstream, relative to the material flow direction, from the casting machine, can cut the cast slab at two different points while it is stationary. The scrap discharge system of this shear is preferably large enough to accommodate all of the material present in the strand in the material flow upstream of the first cutting device, and the separating device can cut up a slab by means of a chopping action.

The time between the cutting operations of the first separating device is preferably no more than 20 seconds.

The vertically movable roller arranged downstream from the first cutting device is provided to produce an adjustable gap perpendicular to the transport direction of the material;

by closing the gap in the direction toward the slab, a straightening process can be carried out at the end of the slab.

The proposed reporting system offers the advantage that an installation is created which can be easily understood by the operator. The entire installation is operated generally at a constant mass flow. The central reporting system creates the possibility of controlling the process when a problem occurs at a subunit, and under certain conditions it can stop the process on the basis of a defined ramp.

A direct line is connected to the first separating device. Thus, in a given case, the material can be cut immediately, so that the casting machine can be freed up as quickly as possible.

The cut-out parts of the slab or strip are collected in a container. The size of the container is adapted to the requirement that the casting machine must be emptied quickly without the need to replace the collection buckets.

The length which is cut out—as previously mentioned—is at least 200 mm, so that as much material as possible can removed per unit time but also so that the separating device does not have to be made unnecessarily large.

It is desirable to make the cutting sequence as short as possible within the scope of the technically realizable limits and is preferably less than 20 seconds. Thus the casting machine can be emptied as quickly as possible.

The vertically adjustable rollers make it possible to continue to use the slabs without causing damage to the following components (such as the furnace) at the same time. The shape of the knife forms an image of itself in the material; that is, a roof-like shape is created in the slab. It is advantageous for this elevation to be removed from the slab by means of the rollers.

According to an elaboration, it is provided that a central fault reporting system is present and used for the entire casting-rolling process. Problems pertaining to the entire installation are detected and reported automatically, or a chief operator can perform this task. After a problem pertaining to the entire installation has been detected, the individual components can be effectively stopped by the automation system. The sequence of the proposed or necessary measures for eliminating the strip material—especially from the casting machine—is preferably carried out automatically, at least in part, by the automation system.

The invention thus creates a method for an emergency strategy applicable to the processing of material in a continuous casting-rolling process, specifically for the situation in which the cast and rolled metal strip has already come to a complete standstill.

Advantageously, the proposed method can be used for all cuttable strip dimensions, so they occur, for example, directly behind the casting machine. Conventionally existing cutting devices can be used so that no additional space is needed in the plant.

It is assumed here, therefore, that a breakdown has occurred during fully continuous operation. The cast strand extending over the entire length of the rolling line is in various stages of processing. By cutting the strand and removing pieces from it according to the invention, the sections of the strand thus obtained are able to move through the installation again; these strand sections can be processed further, which means that as much material as possible remains available for further processing. The individual units of the installation experience no significant damage, and operation can be resumed as quickly as possible.

According to an elaboration, the measures explained above can be carried out in parallel at different points of the installation. For example, a first separating device can be used to cut the strand upstream of the finishing mill and thus produce a gap. The chopping operation, which cannot be done until after the gap-forming cut has been made, can be carried out at a second separating device.

During the chopping step at the separating device, the strand is shortened until the remaining slab becomes shorter than the length of the furnace. It can then be introduced into the furnace for further processing; that is, the remaining slab is loaded into the furnace so that it will be ready to be rolled as soon as the capacity to roll has been restored.

It is preferably provided that the end of the slab is straightened by movable rollers in the area of the shear. The movable rollers can be arranged upstream and/or downstream of the separating device to straighten the head and/or the tail of the slab.

According to an elaboration of the method, the strip material can also be conveyed in reverse from the finishing mill, opposite the transport direction (conventional straightening of the material), and cut by the separating device.

This piece of strip material, however, can also be conveyed from the finishing mill to the coiler and removed from the roller table there, possibly in association with a manual cutting operation and appropriate crane operations.

Lowering the first roller downstream from the separating device is advantageous as a way of assisting the first cut, i.e., the gap-forming cut.

The use of a scrap conveyor belt at the separating device is also advantageous, so that the cut-off scrap can be carried away efficiently.

The separating devices are preferably designed as oscillating shears or as movable gate shears, which make it especially easy to cut a gap.

Accordingly, the advantage is obtained that the ability to operate can be restored quickly after a breakdown during endless operation. Damage and thus down times to allow replacement of components can thus be avoided.

It is possible to convey the strand out of the casting machine quickly. As a result, damage to the mold and extreme thermal load on the strand guide rollers can be avoided.

With respect to the chopping operation, the amount of strip arriving in the transport direction during the time between two separations corresponds to the length of strip which is cut off. With respect to the gap-producing operation, the length of new strip arriving in the transport direction during the time between two separations is preferably shorter than the length which is separated by two successive separations. The limit case with the gap of maximum size is the situation which exists when the strip is stationary. For this reason, it is necessary to be able to make the cuts at different points.

An exemplary embodiment of the invention is illustrated in the drawing:

DETAILED DESCRIPTION OF THE INVENTION

Figure 1:
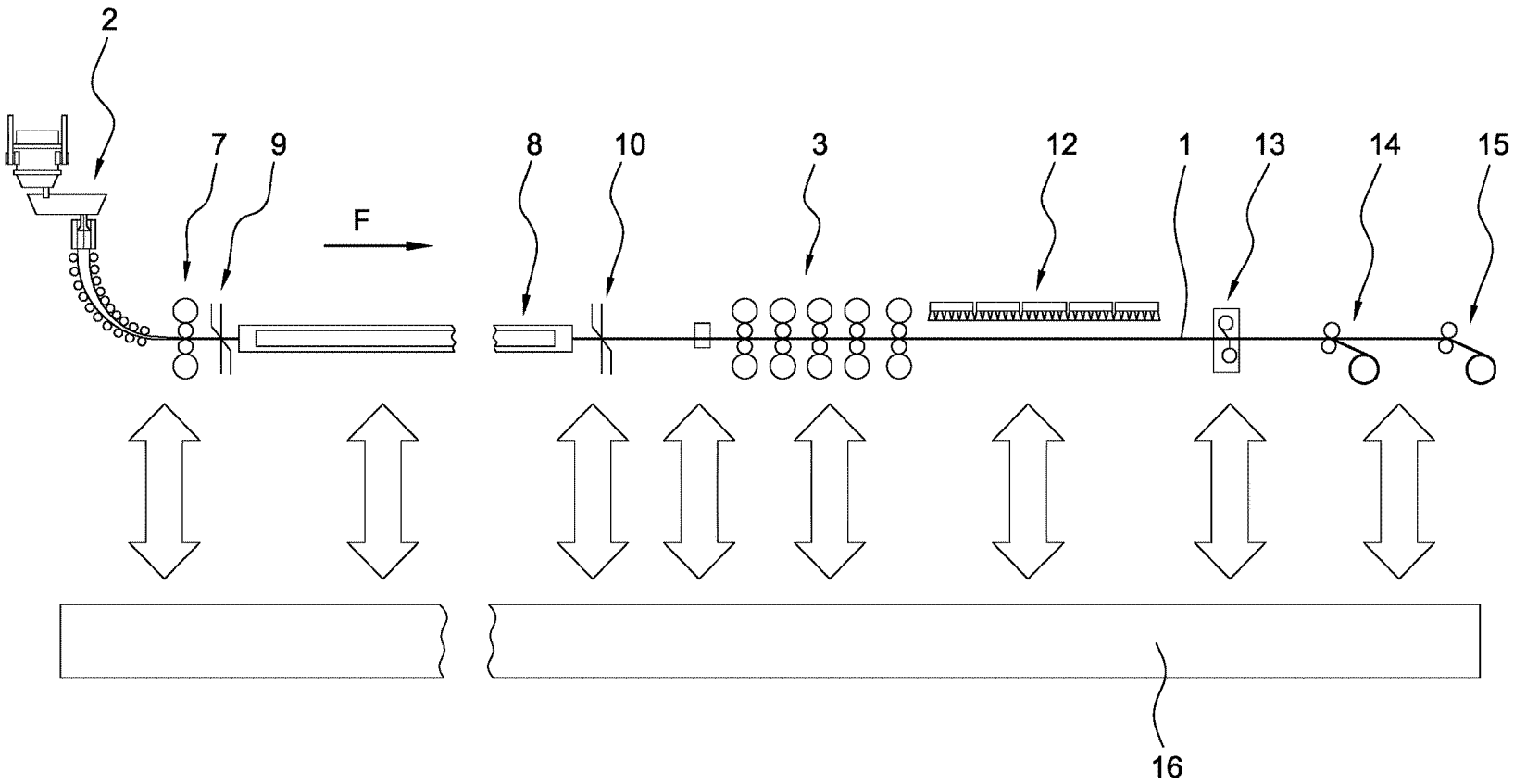
FIG. 1 shows a schematic diagram of a casting-rolling installation for the production of steel strip.

FIG. 1 shows a sketch of an example of a casting-rolling installation, which is designed as a fully continuous installation and which comprises as its central elements a casting machine 2 and a finishing mill 3. Downstream from the casting machine 2 is a roughing mill 7, to which, depending on the plant design, a furnace 8 (connecting roller table with heating function) is connected. Downstream from the furnace 8 is the finishing mill 3. Downstream from the finishing mill 3 is a cooling section 12 and a flying shear 13. Next in the transport direction F is at least one coiler 14, 15.

Between the roughing mill 7 and the furnace 8, a first separating device 9 for the strip 1 in the form of an oscillating shear is arranged. A second separating device 10 of the same type is located between the furnace 8 and the finishing mill 3.

Naturally, the proposed method can also be used in a different type of casting-rolling installation.

By the use of sensors (not shown), the complete installation is monitored by a central fault reporting system 16.

During endless rolling, the installation is completely filled by a strand, that is, by a continuous strip 1. When a breakdown occurs, the strand or the strip comes to a stop. Because of the length of the installation, the operating personnel cannot see the entire line. A problem occurs in only one part of the installation and usually triggers an immediate stop of this part. This leads to an uncontrolled backup of material or to traction on the material in the other parts of the installation if a controlled stop at a suitable deceleration rate is not initiated in these other parts. As a result, damage can be caused to various parts of the installation. In addition, a material backup can develop, and until it has been corrected it is impossible for production to continue.

Because all of the parts of the installation are connected, stopping the material means that the entire strand or strip 1 can no longer move. According to the invention, a gap is intentionally produced, so that the slab will be able to move again. In addition, the casting machine 2 must be freed of material as quickly as possible so as not to "freeze". It should also be possible to send as much as possible of the still-usable material present in the installation to further processing.

The inventive solution proceeds on the basis of the following units in the installation:

As described above, the installation is configured essentially as shown in FIG. 1. A typical element of a fully continuous casting-rolling installation of this type is the central fault reporting system 16 and the separating devices 9, 10, and 13.

All of the fault reports are collected in the higher-level central fault reporting system 16, so that the necessary measures can be implemented effectively in the concrete case.

The separating device 9 situated upstream relative to the transport direction F is designed as, for example, an oscillating shear or a movable gate shear. The separating device 9 has the property of being able to make, in a short time, several separating cuts in stationary and/or moving material at positions within the separating device which differ in the transport direction. The separating device also comprises a scrap discharge system 17 (see, for example, FIG. 2).

It is advantageous into another separating device 10, which is arranged downstream from the furnace 8 and upstream from the finishing mill 3; this separating device 10 is therefore downstream from the separating device 9 in the production line, but it can be designed in exactly the same way as the separating device 9, including the scrap discharge system 17.

Devices are provided in the casting machine 2, furthermore, which make it possible to bring the casting process to a standstill quickly and which allow the cast strand to be transported again after a defined maximum period of time.

The central fault reporting and response system 16, which it is advantageous to provide, covers the entire installation. If, for example, a material flow problem occurs in the finishing mill 3 or if such a problem becomes evident, a signal must be transmitted immediately to all of the other units and controls in the installation, so that the individual units and drives can be stopped simultaneously in a controlled manner.

After the signal "fault" has been sent, the casting machine 2 is also stopped in a controlled manner; that is, no more molten steel may be allowed to enter the mold, and the machine must be brought to a standstill.

A fault is detected either by suitable sensors (speed indicators, strip tension meters, loop lifters, etc.) of the installation's automation system or by the operating personnel in one of the areas of the installation.

The proposed method and the installation equipment necessary to implement it are provided to allow the separation of a stationary or nearly stationary material strand (transport speed of less than 1 m/min) in a short time and thus to make it possible to empty the casting machine 2.

The specific sequence of steps of the method is illustrated by way of example in FIGS. 2-11. The essential idea here is to create the possibility of cutting a gap in the stationary material or strip 1. This gap makes it possible to resume the transport of the strip, so that the strip material can be chopped into scrap and removed from the installation.

Figure 2:
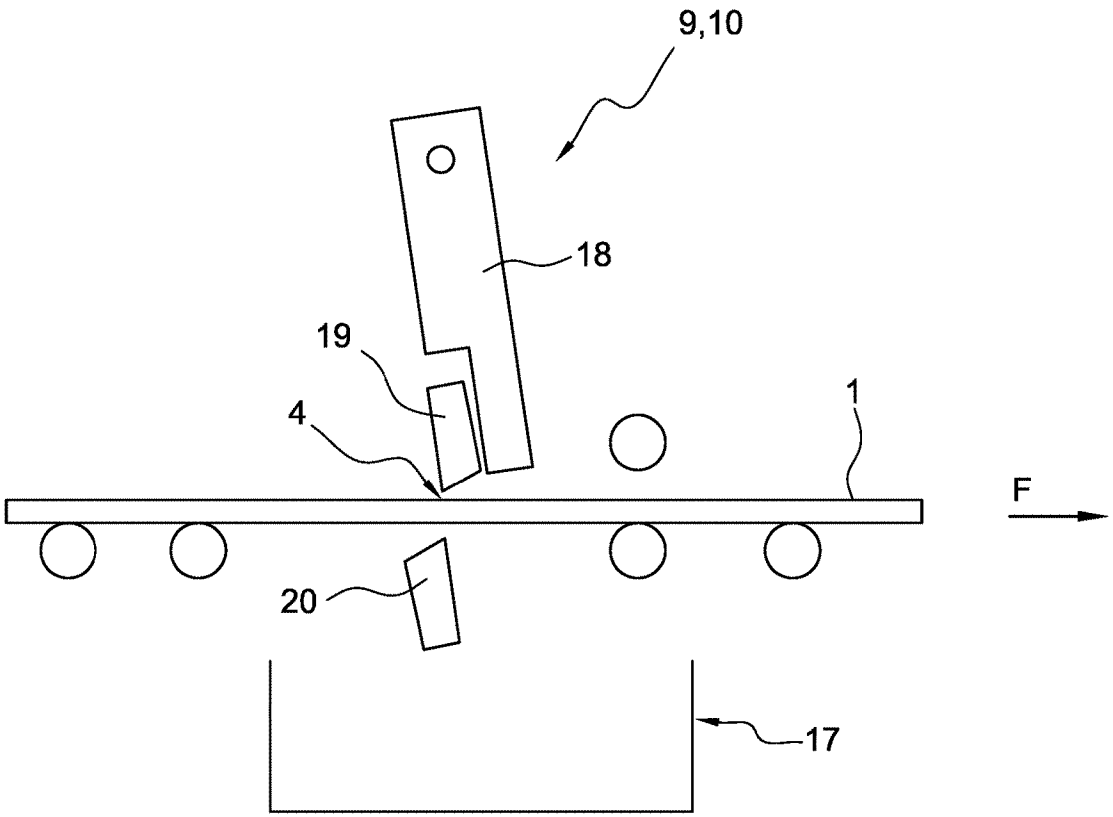
FIG. 2 shows a section of the strip with a separating device in the form of an oscillating shear during a first substep of the proposed method.

FIG. 2 shows a separating device 9, 10. This could represent, for example, the second separating device 10. The separating device is designed as an oscillating shear.

The shear carrier 18 of the oscillating shear 10 is first pivoted as illustrated in FIG. 2 (around an axis perpendicular to the plane of the drawing in FIG. 2), so that the shearing elements 19 and 20 are located at a first point 4 of the installation. The strip 1 is completely at rest here; that is, the transport speed in the transport direction is therefore, in practice, zero.

Figure 3:
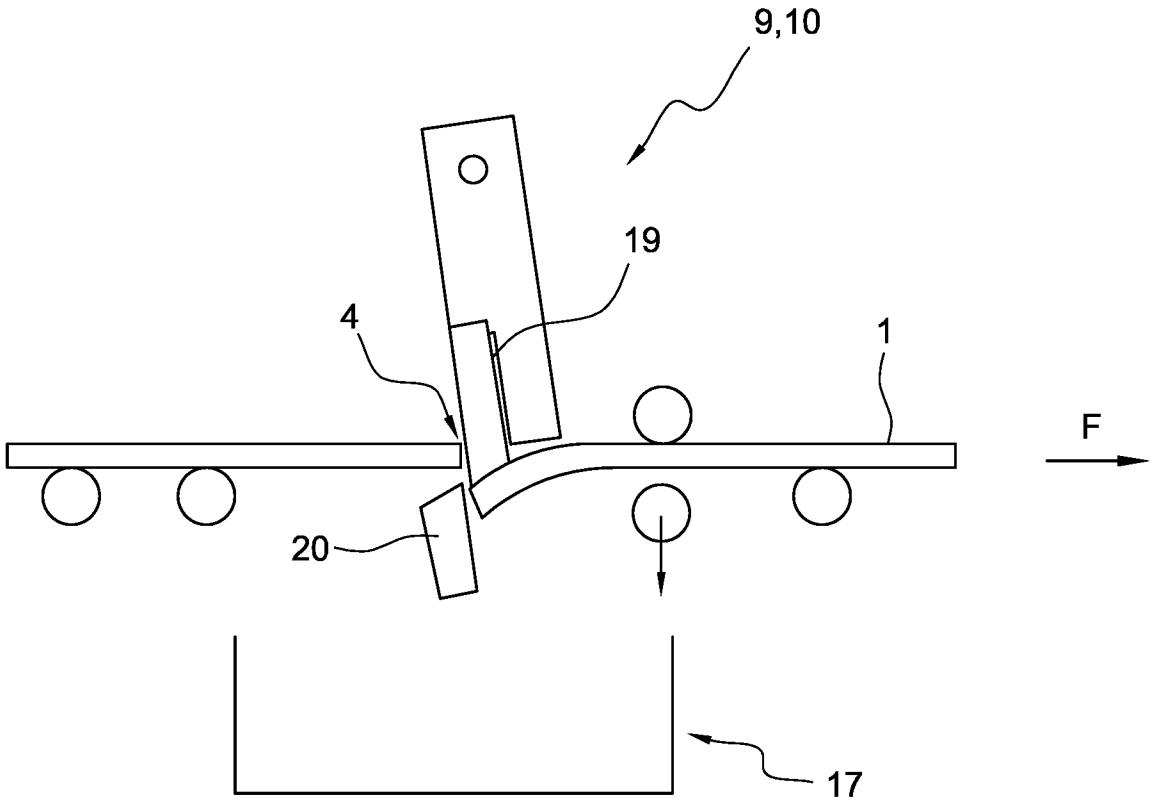
FIG. 3 shows the section of the strip with the separating device during a second substep of the proposed method.
Figure 4:
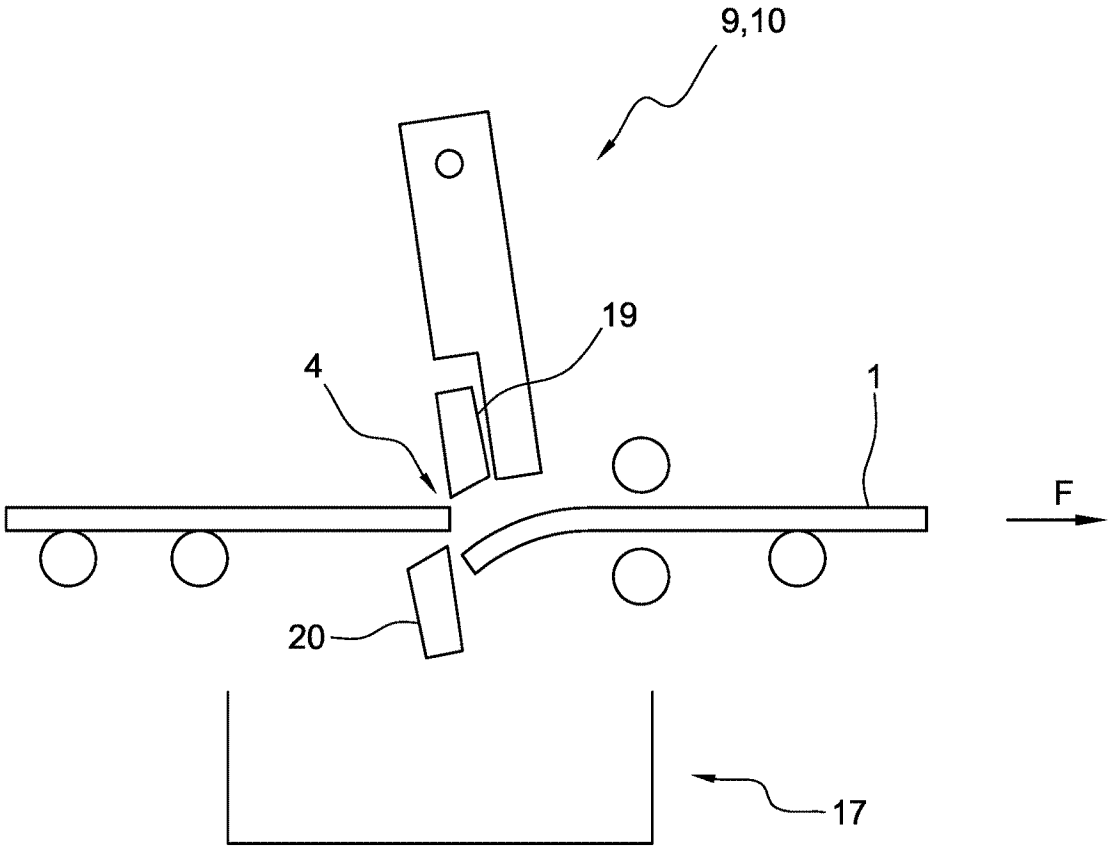
FIG. 4 shows the section of the strip with the separating device during a third substep of the proposed method.

In FIG. 3 we see how the shearing elements 19, 20 have been moved toward each other to cut through the strip 1 at the first point 5. The shearing elements 19, 20 are then moved back away from each other again—as shown in FIG. 4; the strip 1 is now separated at the first point 4.

Figure 5:
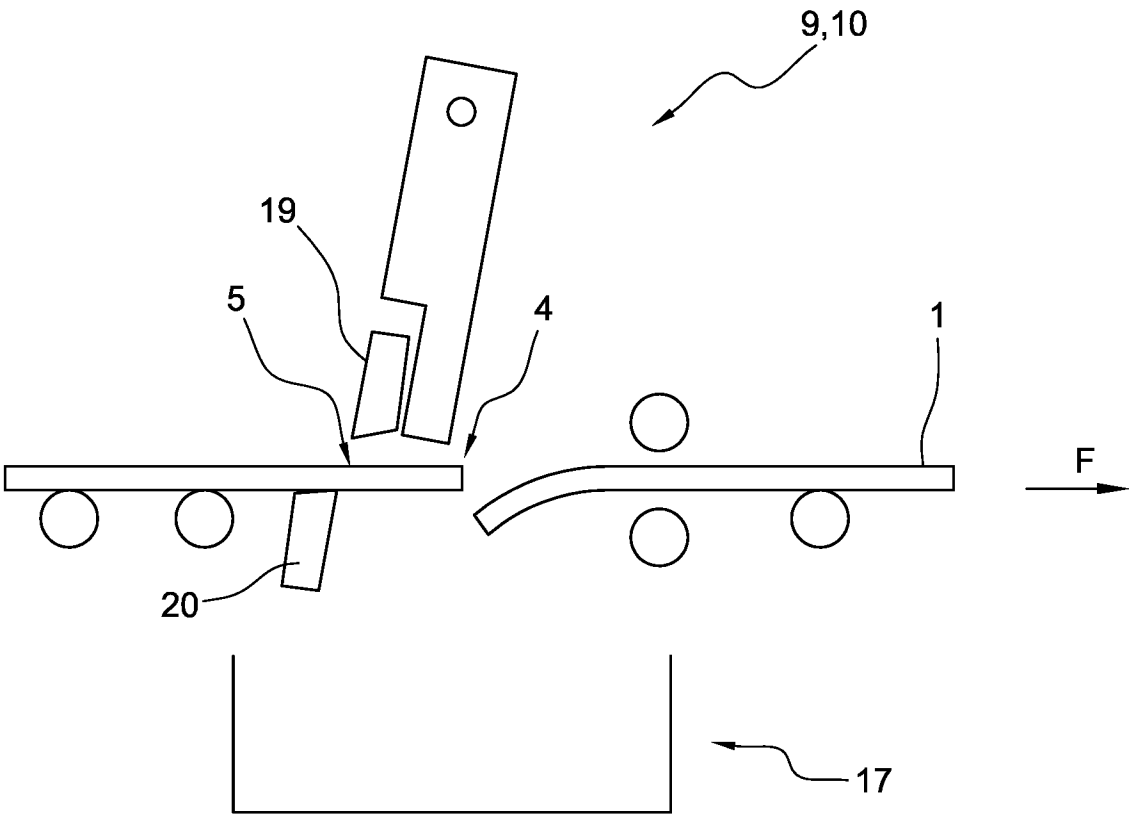
FIG. 5 shows the section of the strip with the separation device during a fourth substep of the proposed method.
Figure 6:
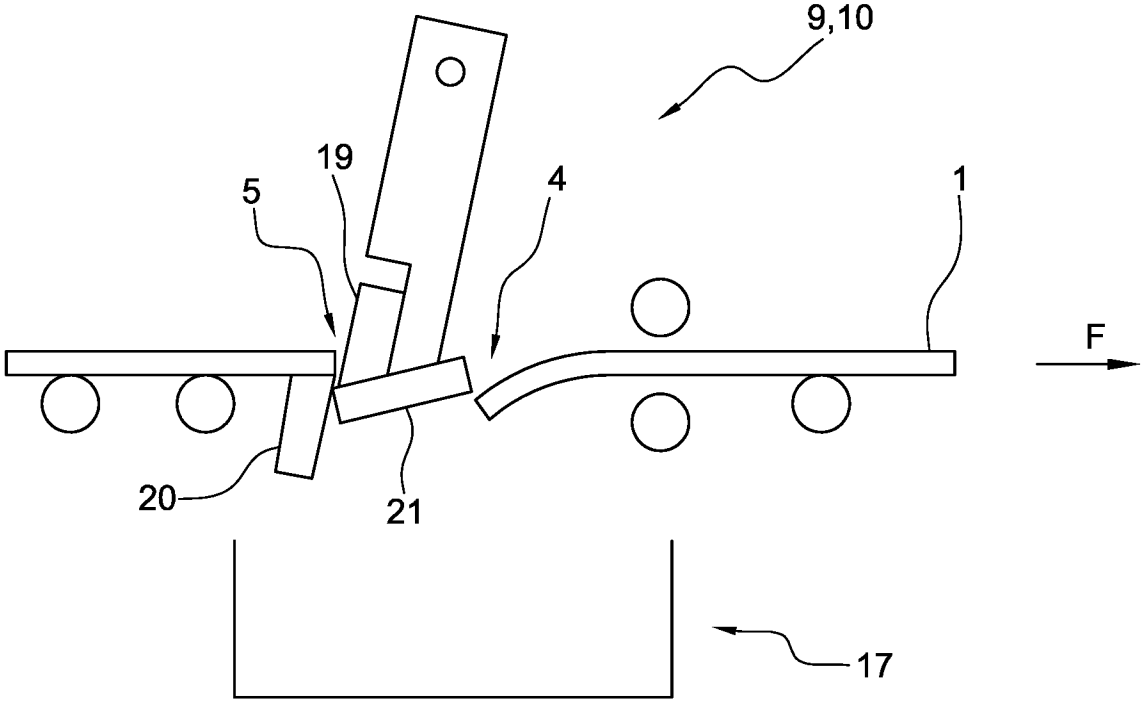
FIG. 6 shows the section of the strip with the separation device during a fifth substep of the proposed method.

Now, as can be seen in FIG. 5, the shear carrier 18 is pivoted so that the shear elements 19, 20 arrive at a second point 5 of the installation. Now, according to FIG. 6, another cut is made, and thus a piece 21 of strip is cut away from the strip 1. The first and second points 5, 4 are usually 0.2-1.5 m apart from each other.

Figure 7:
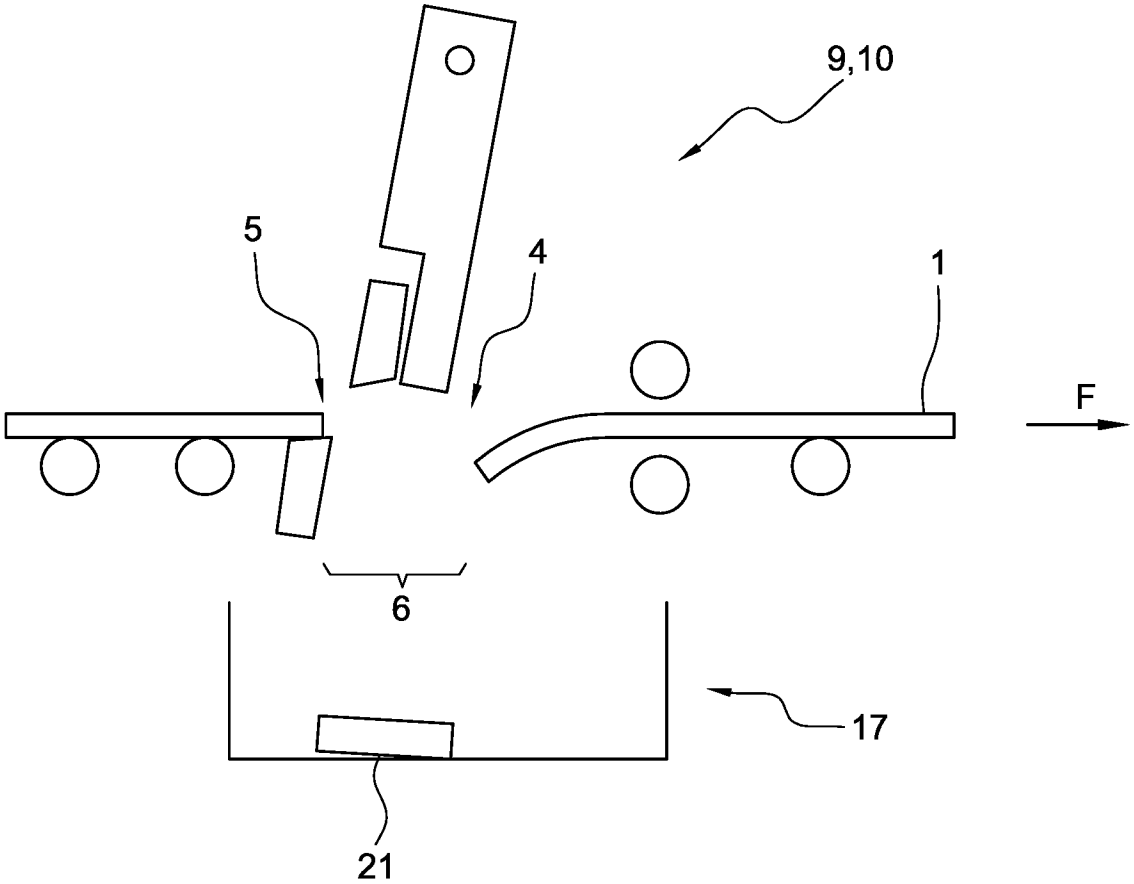
FIG. 7 shows the section of the strip with the separation device during a sixth substep of the proposed method.

This piece 21 falls down into the area of a scrap discharge system 17 (shown only in highly schematic fashion), as can be seen in FIG. 7. A gap 6 remains in the strip 1.

Figure 8:
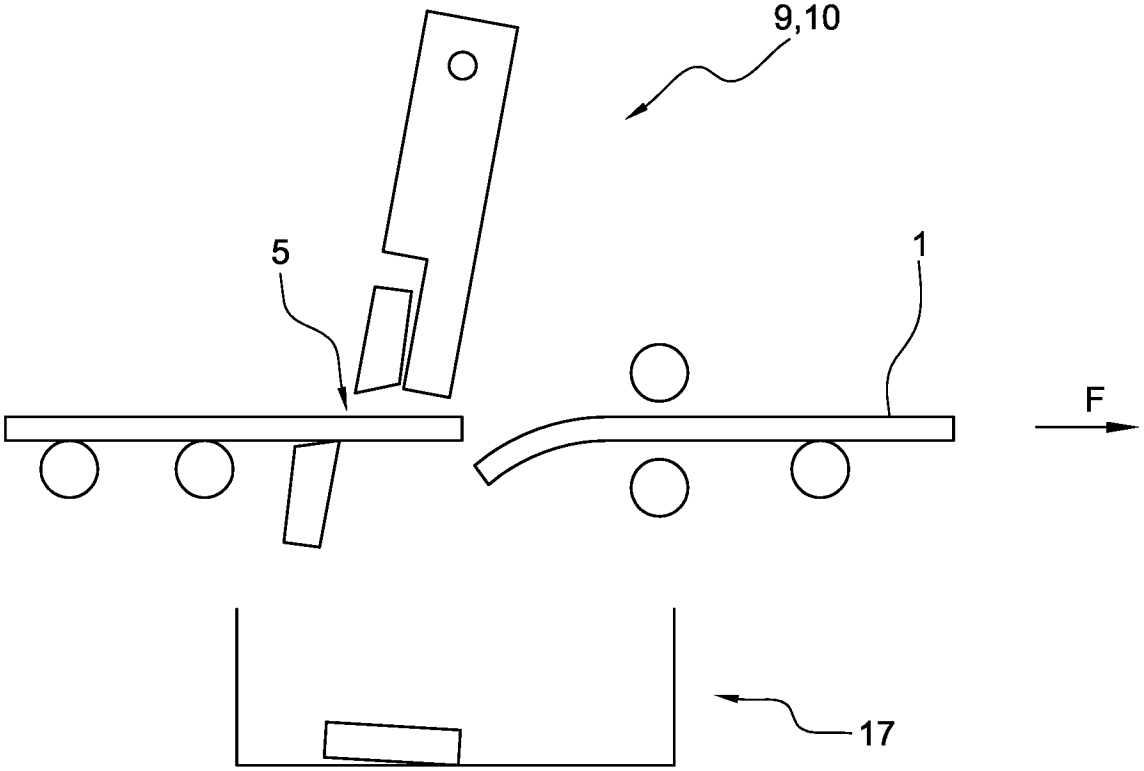
FIG. 8 shows the section of the strip with the separation device during a seventh substep of the proposed method.

The strip 1 can now travel from the left into the gap 6 thus created, while the strip 1 on the right remains at rest. This is illustrated in FIG. 8. The strip is fed from the casting machine 2 into the gap at a creep, and thus the chopping operation starts, by which the strip 1 coming from the left is cut into pieces 21 and then removed from the area of the casting machine 2.

Figure 9:
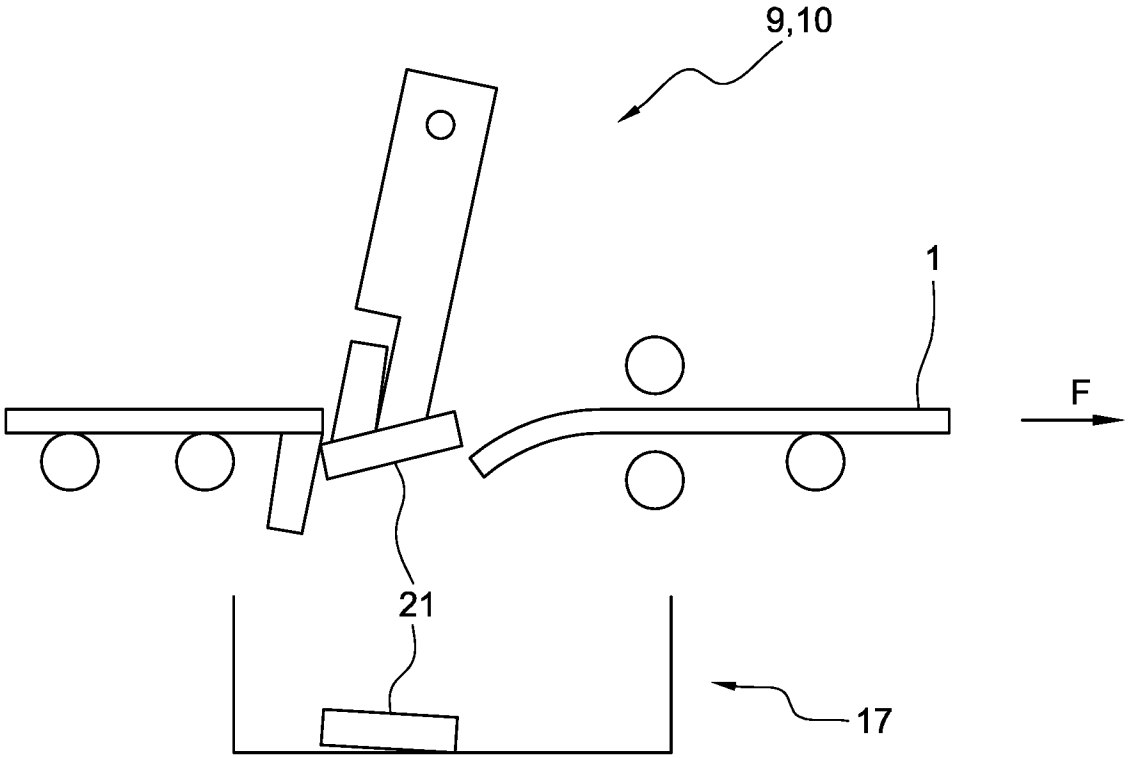
FIG. 9 shows the section of the strip with the separation device during an eighth substep of the proposed method.
Figure 10:
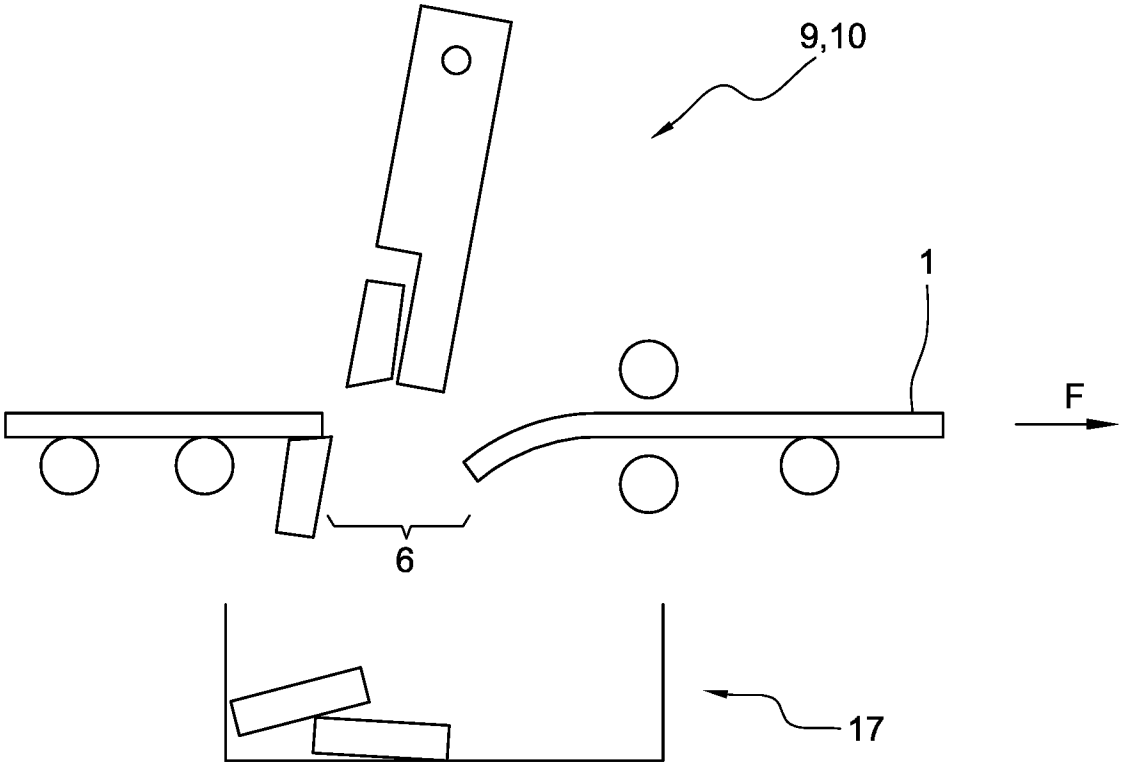
FIG. 10 shows the section of the strip with the separation device during a ninth substep of the proposed method.

As can be seen in FIG. 9, another piece 21 is cut out after a sufficient amount of strip, coming from the left, has arrived in the area of the gap 6. After the piece 21 has been cut off, as can be seen in FIG. 10, the gap 6 is again available for the chopping-off of additional strip material.

The chopping process continues until the strip or slab coming from the casting machine 2 has been cut into pieces 21 and removed by the scrap discharge system 17. In this way, the casting machine 2 is freed of strip material, and as much of the remaining slab as desired is removed.

Figure 11:
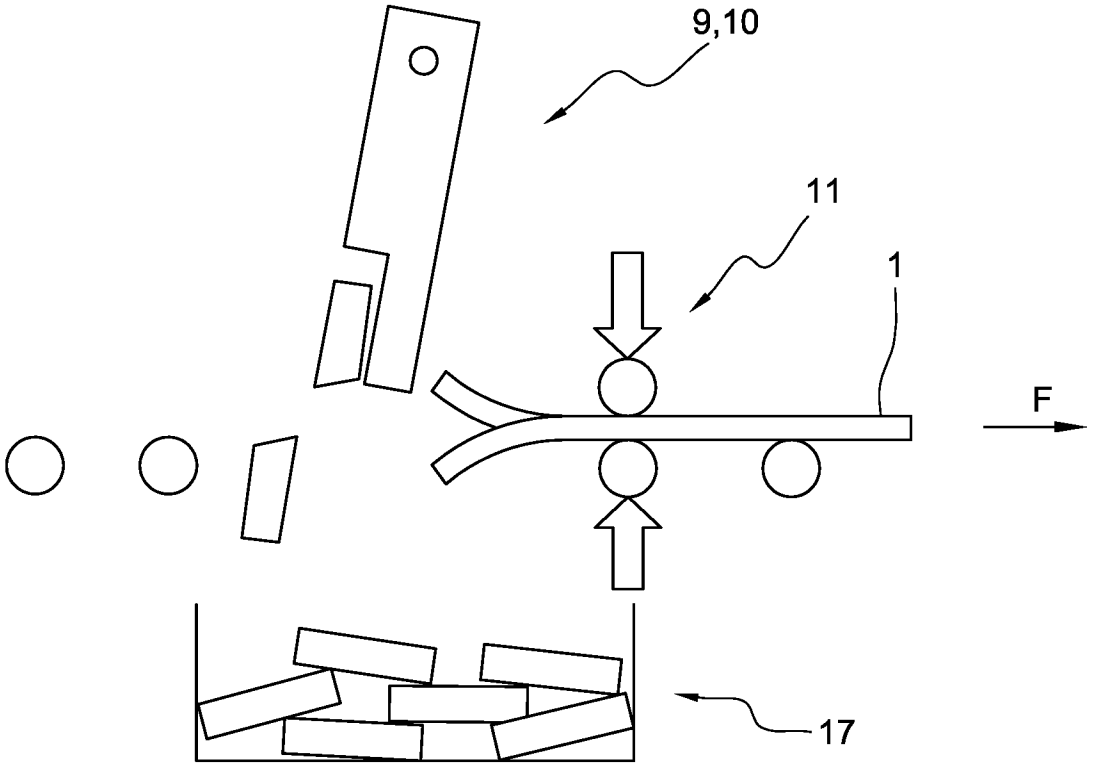
FIG. 11 shows the section of the strip with the separation device during a tenth substep of the proposed method.

It can be seen in FIG. 11, furthermore, how the tail end of the still-stationary strip 1 can be straightened in the area on the right of the figure. For this purpose, means 11 for applying a straightening force are provided, so that the tail end of the strip can be straightened. The central part of the means 11 consists of vertically movable rollers, which can press against the surface of the strip.

Depending on the design of the casting installation, the casting process can now resume.

The separating devices 9, 10 can be used alternatively or additively as described.

As a combination variant of the method, it is also possible for the separating device 10 to cut the gap 6, whereas the remaining strand proceeding from the casting machine 2 is chopped into scrap at the separating device 9 and removed by the scrap removal system there.

LIST OF REFERENCE NUMBERS

1 strip
2 casting machine
3 finishing mill
4 first point
5 second point
6 gap
7 roughing mill
8 furnace
9 first separating device (oscillating shears/gate shears)
10 second separating device (oscillating shears/gate shears)
11 means for applying a straightening force
12 cooling section
13 flying shear
14 coiler
15 coiler
16 fault reporting system
17 scrap discharge system/scrap collector
18 shear carrier
19 shear element
20 shear element
21 piece of strip material
F transport direction

The invention claimed is:

1. A method for producing a metallic strip by a continuous casting-rolling process, comprising the steps of:

casting a slab in a casting machine;

sending the slab to a finishing mill located downstream, relative to a transport direction of the strip, and rolling the strip;

upon occurrence of a breakdown where transport of the slab or strip has come to a complete or substantially complete standstill, the following steps are carried out:

(a) cutting through the strip at a first point using a separating device that is pivotable about an axis transverse to the transport direction;

(b) pivoting the separating device in a direction opposite the transport direction and cutting through the strip at a second point that is 0.1-5.0 m upstream, relative to the transport direction, from the first point using the separating device to create a cut-out piece;

(c) removing the cut-out piece of strip from the strip to create a gap in the strip;

(d) conveying new strip material into an area of the gap from an area located upstream, relative to the transport direction, of the first point; and (e) cutting off pieces of the new strip material conveyed from upstream according to step (d) and removing the pieces from the new strip material, wherein the cutting off pieces of new strip material is carried out using the separating device.

2. The method according to claim 1, wherein the first and second points lie between the casting machine and the finishing mill.

3. The method according to claim 2, wherein the first and second points lie between a roughing mill following immediately after the casting machine in the transport direction and a furnace following the roughing mill in the transport direction.

4. The method according to claim 2, wherein the first and second points lie between a furnace following the casting machine in the transport direction and the finishing mill.

5. The method according to claim 1, wherein the separating device is an oscillating shear or a movable gate shear.

6. The method according to claim 1, wherein steps (d) and (e) are repeated until the casting machine has been freed of strip material or until a section of defined length in the casting machine is free of strip material.

7. The method according to claim 1, wherein steps (a)-(c) are performed by a first separating device, and steps (d) and (e) are performed by a second separating device, wherein the two separating devices are arranged at different locations relative to the transport direction.

8. The method according to claim 1, wherein strip material is conveyed out of the finishing mill opposite the transport direction into an area of at least one separating device, and pieces of the conveyed strip material are cut off in the at least one separating device and removed from the transport line.

9. The method according to claim 8, further including arranging a device next to the at least one separating device that applies a straightening force to the strip material, which force is perpendicular to a surface of the strip material.

10. The method according to claim 1, wherein the gap is produced by more than two cuts of the separating device.

* * * * *